US008540932B2

(12) United States Patent
Genma et al.

(10) Patent No.: US 8,540,932 B2
(45) Date of Patent: Sep. 24, 2013

(54) FERRITIC SPHEROIDAL GRAPHITE CAST IRON

(75) Inventors: Yoshikazu Genma, Toyota (JP); Go Kuramoto, Toyokawa (JP); Yoshihiro Hibino, Aichi-ken (JP); Zhong-zhi Zhang, Kariya (JP); Takeyuki Sakuma, Okazaki (JP)

(73) Assignees: Toyota Jidosha Kabushiki Kaisha, Toyota-shi, Aichi-ken (JP); Aisin Takaoka Co., Ltd., Toyota-shi, Aichi-ken (JP)

( * ) Notice: Subject to any disclaimer, the term of this patent is extended or adjusted under 35 U.S.C. 154(b) by 30 days.

(21) Appl. No.: 13/202,782

(22) PCT Filed: Feb. 19, 2010

(86) PCT No.: PCT/IB2010/000323

§ 371 (c)(1),
(2), (4) Date: Aug. 23, 2011

(87) PCT Pub. No.: WO2010/097673

PCT Pub. Date: Sep. 2, 2010

(65) Prior Publication Data

US 2011/0297280 A1 Dec. 8, 2011

(30) Foreign Application Priority Data

Feb. 27, 2009 (JP) ..... 2009-045636

(51) Int. Cl.

| | |
|---|---|
| ***C22C 37/04*** | (2006.01) |
| ***C22C 37/06*** | (2006.01) |
| ***C21D 5/00*** | (2006.01) |

(52) U.S. Cl.
USPC ..... 420/15; 420/19; 420/25; 148/614; 148/618; 148/321

(58) Field of Classification Search
USPC ..... 420/15–27; 148/612, 614, 618, 148/321
See application file for complete search history.

(56) References Cited

U.S. PATENT DOCUMENTS

2004/0091383 A1 * 5/2004 Suzuki et al. ..... 420/27

FOREIGN PATENT DOCUMENTS

| | | | | |
|---|---|---|---|---|
| DE | 101 01 159 | A1 | 7/2002 | |
| EP | 1 440 748 | A1 | 7/2004 | |
| JP | 59-193242 | | 11/1984 | |
| JP | 359193242 | A * | 11/1984 | ..... 420/17 |
| JP | 61-279655 | | 12/1986 | |
| JP | 9-87796 | | 3/1997 | |
| JP | 10-195587 | | 7/1998 | |
| JP | 2006-169635 | | 6/2006 | |

(Continued)

OTHER PUBLICATIONS

Machine-English translation of Japanese patent No. 2002-371335, Chiyou Shiyoushiyoku et al., Dec. 26, 2002.*

(Continued)

*Primary Examiner* — Deborah Yee
(74) *Attorney, Agent, or Firm* — Finnegan, Henderson, Farabow, Garrett & Dunner, LLP

(57) ABSTRACT

Ferritic spheroidal graphite cast iron includes: 3.1 to 3.5 percent by mass of carbon; 4.1 to 4.5 percent by mass of silicon; 0.8 percent by mass or below of manganese; 0.1 to 0.6 percent by mass of molybdenum; 0.1 to 1.0 percent by mass of chromium; 0.03 to 0.1 percent by mass of phosphorus; 0.03 percent by mass or below of sulfur; 0.02 to 0.15 percent by mass of magnesium; and iron.

12 Claims, 9 Drawing Sheets

(56) References Cited

FOREIGN PATENT DOCUMENTS

| | | | |
|---|---|---|---|
| JP | 2008-510071 | | 4/2008 |
| WO | WO 03/057937 | A1 | 7/2003 |
| WO | WO 2008/112720 | A1 * | 9/2008 |

OTHER PUBLICATIONS

K.B. Rundman, "Annealing Ductile Iron", Heat treat of Ductile Irons, Heat Treating, vol. 4, ASM Handbook, ASM International, 1991, http://products.asminternational.org.*

International Search Report in International Application No. PCT/IB2010/000323; Mailing Date: May 12, 2010.

Written Opinion of the International Searching Authority in International Application No. PCT/IB2010/000323; Mailing Date: May 12, 2010.

Notification of Reason(s) for Refusal in Japanese Patent Application No. 2009-045636; Drafting Date: Jun. 15, 2011.

* cited by examiner

FERRITIC SPHEROIDAL GRAPHITE CAST IRON

CROSS-REFERENCE TO RELATED APPLICATIONS

This application is a national phase application of International Application No. PCT/IB2010/000323, filed Feb. 19, 2010, and claims the priority of Japanese Application No. 2009-045636, filed Feb. 27, 2009, the contents of both of which are incorporated herein by reference.

BACKGROUND OF THE INVENTION

1. Field of the Invention

The invention relates to a ferritic spheroidal graphite cast iron and, more particularly, to a ferritic spheroidal graphite cast iron having an excellent heat resistance and oxidation resistance.

2. Description of the Related Art

Materials of exhaust system components, such as an exhaust manifold of an automobile and a turbocharger of a diesel engine, are subjected to service conditions in which high-temperature heating and cooling are repeated. Therefore, these components require oxidation resistance and thermal fatigue resistance. In recent years, with an increase in power and reduction in fuel consumption of an engine, exhaust gas temperature has further increased, and the above request for oxidation resistance and thermal fatigue resistance is further remarkable.

In terms of low cost and easily moldable characteristic, spheroidal graphite cast iron is used as a material that satisfies oxidation resistance and thermal fatigue resistance. However, ferritic spheroidal graphite cast iron decreases its ductility around 400° C. (intermediate temperature embrittlement phenomenon). This phenomenon is peculiar to spheroidal graphite cast iron.

In consideration of the above, Japanese Patent Application Publication No. 10-195587 (JP-A-10-195587) suggests spheroidal graphite cast iron that includes carbon (C), silicon (Si) and manganese (Mn) as principal components, includes at least magnesium (Mg) as a graphite spheroidization component and includes at least one selected from the group consisting of chromium (Cr), molybdenum (Mo), tungsten (W), titanium (Ti), vanadium (V), nickel (Ni) and copper (Cu) as a matrix reinforcing component, and the remaining portion is made of iron (Fe) and unavoidable impurities, and then the graphite cast iron includes 0.03 to 0.20 percent by weight of arsenic (As).

However, the oxidation resistance of ferritic spheroidal graphite cast iron is considerably poorer than that of austenitic cast iron under high-temperature environment around 800° C.

The oxidation resistance of the material described in JP-A-10-195587 is better than the oxidation resistance of ferritic spheroidal graphite cast iron having a high content of Si; however, it is not sufficient when used as the material of the above described parts. This is because a ferrite phase, which is a matrix of ferritic cast iron, is more easily oxidized at 800° C. or above than an austenite phase, which is a matrix of austenitic cast iron. In addition, the oxidation resistance may be improved by increasing the content of Si; however, with an increase in the content of Si, the thermal fatigue characteristic may be impaired.

In consideration of the above, when austenitic cast iron that has an austenite phase and that includes 35 percent by mass of Ni is used as the material of the above parts, addition of a predetermined amount of Ni increases manufacturing cost of cast iron itself.

SUMMARY OF THE INVENTION

The invention provides ferritic spheroidal graphite cast iron that is able to improve oxidation resistance at high temperatures with low cost.

A first aspect of the invention relates to a ferritic spheroidal graphite cast iron. The ferritic spheroidal graphite cast iron includes: 3.1 to 3.5 percent by mass of carbon; 4.1 to 4.5 percent by mass of silicon; 0.8 percent by mass or below of manganese; 0.1 to 0.6 percent by mass of molybdenum; 0.1 to 1.0 percent by mass of chromium; 0.03 to 0.1 percent by mass of phosphorus; 0.03 percent by mass or below of sulfur; 0.02 to 0.15 percent by mass of magnesium; and iron.

In the ferritic spheroidal graphite cast iron according to the above aspect, the mass ratio of the content of chromium to the content of molybdenum may range from 1.0 to 3.5. The ferritic spheroidal graphite cast iron according to the above aspect may be subjected to ferritizing heat treatment by which a pearlite structure of a cast iron structure is transformed into a ferrite structure, or may further include unavoidable impurities.

In the ferritic spheroidal graphite cast iron according to the above aspect, the sum, of the product of the content of silicon multiplied by ⅓ and the content of carbon may range from 4.5 to 5.0 percent by mass, the content of manganese may be higher than or equal to 0.16 percent by mass, the content of sulfur may be higher than or equal to 0.002 percent by mass, or the content of molybdenum may be higher than or equal to 0.15 percent by mass.

A second aspect of the invention relates to a manufacturing method for ferritic spheroidal graphite cast iron. The manufacturing method includes: preparing raw material that includes carbon, silicon, manganese, molybdenum, chromium, phosphorus, sulfur, magnesium and iron; melting the raw material; applying graphite spheroidization by adding Fe—Si—Mg alloy to the melted raw material; inoculating the raw material, which has been subjected to the graphite spheroidization, using Fe—Si; and casting the inoculated raw material at 1400° C. or above. In the manufacturing method, the inoculated raw material may include 3.1 to 3.5 percent by mass of carbon, 4.1 to 4.5 percent by mass of silicon, 0.16 to 0.8 percent by mass of manganese, 0.1 to 0.6 percent by mass of molybdenum, 0.1 to 1.0 percent by mass of chromium, 0.03 to 0.1 percent by mass of phosphorus, 0.002 to 0.03 percent by mass of sulfur, and 0.02 to 0.15 percent by mass of magnesium.

In the manufacturing method according to the above aspect, the mass ratio of the content of chromium to the content of molybdenum in the inoculated raw material may range from 1.0 to 3.5.

The manufacturing method according to the above aspect may further include: maintaining the cast raw material at 750° C. to 950° C. for 2 to 3 hours; maintaining the raw material, which has been maintained at 750° C. to 950° C., at 500° C. to 750° C. for 3 to 6 hours; and cooling the raw material that has been maintained at 500° C. to 750° C.

In the manufacturing method according to the above aspect, the sum of the product of the content of silicon in the inoculated raw material multiplied by ⅓ and the content of carbon in the inoculated raw material may range from 4.5 to 5.0 percent by mass, or the content of molybdenum in the inoculated raw material may be higher than or equal to 0.15 percent by mass.

According to the aspects of the invention, even ferritic cast iron is able to exhibit high-temperature oxidation resistance that is substantially equivalent to austenitic cast iron.

BRIEF DESCRIPTION OF THE DRAWINGS

The foregoing and further objects, features and advantages of the invention will become apparent from the following description of example embodiments with reference to the accompanying drawings, wherein like numerals are used to represent like elements and wherein:

FIG. 1A and FIG. 1B are graphs that show the results of tensile tests on Examples 1 and 2 and Comparative examples 1 and 2, in which FIG. 1A is a graph that shows the results of tensile strength tests at room temperature and FIG. 1B is a graph that shows the results of tensile strength tests at 800° C.;

DETAILED DESCRIPTION OF EMBODIMENTS

Figure 1A:
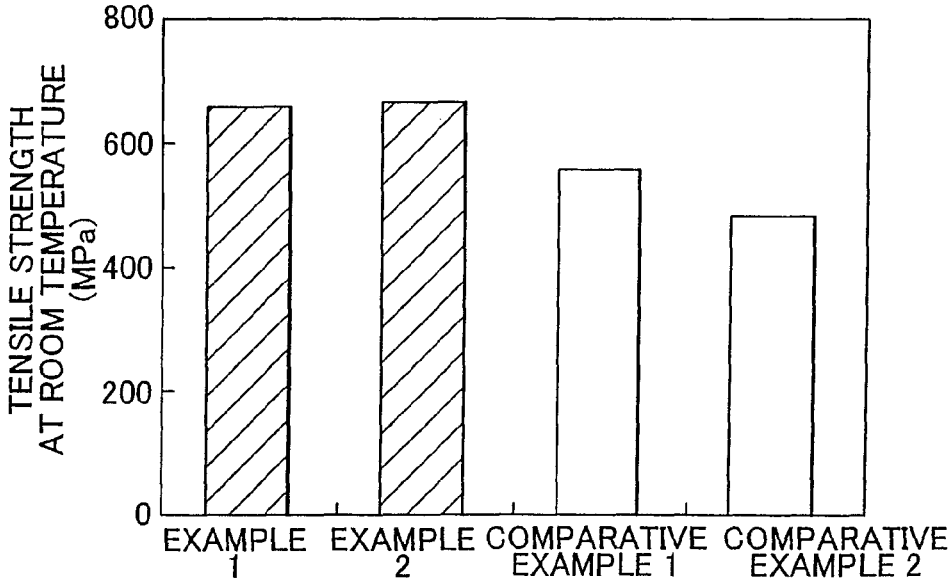

Hereinafter, ferritic spheroidal graphite cast iron according to an embodiment of the invention will be described. The ferritic spheroidal graphite cast iron according to the present embodiment basically includes 3.1 to 3.5 percent by mass of carbon (C), 4.1 to 4.5 percent by mass of silicon (Si), 0.8 percent by mass or below of manganese (Mn), 0.1 to 0.6 percent by mass of molybdenum (Mo), 0.1 to 1.0 percent by mass of chromium (Cr), 0.03 to 0.1 percent by mass of phosphorus (P), 0.03 percent by mass or below of sulfur (S), 0.02 to 0.15 percent by mass of magnesium (Mg), and iron (Fe) and unavoidable impurities as the remainder.

Here, these additive elements will be described below. C and Si are component elements involved with crystallization of graphite for forming graphite cast iron. For cast iron, the content of C and the content of Si need to be set in consideration of carbon equivalent (CE value). The CE value may be calculated by the following mathematical expression.

$$\text{CE Value} = \text{Content of C(percent by mass)} + \tfrac{1}{3} \times \text{Content of Si(percent by mass)}$$

Here, the CE value may range from 4.5 to 5.0. When the CE value is smaller than 4.5, the composition is almost eutectic, which causes shrinkage defects (shrinkage cavities). When the CE value exceeds 5.0, the amount of crystallization of graphite becomes excessive, which may cause a decrease in strength. Then, in order to satisfy the content of Si, which will be described later, and the CE value, the content of C ranges from 3.1 to 3.5 percent by mass.

Si is a component element that influences oxidation resistance. When the content of Si is lower than 4.1 percent by mass, it is difficult to obtain sufficient oxidation resistance. When the content of Si exceeds 4.5 percent by mass, the ferrite phase of the matrix becomes brittle.

Mn is a component element for removing sulfur (reacting with sulfur to become MnS) that is an undesirable element for cast iron. When the content of Mn exceeds 0.8 percent by mass, the structure of cast iron has an increasing tendency to be chilled and, therefore, the cast iron may become brittle.

Mo is an effective component element for improving oxidation resistance and high-temperature strength. When the content of Mo is lower than 0.1 percent by mass, it is difficult to develop the above effects. On the other hand, when the content of Mo exceeds 0.6 percent by mass, the toughness of cast iron may decrease. More desirably, the lower limit of the content of Mo is 0.15 percent by mass.

Cr is an effective component element for improving oxidation resistance and high-temperature strength. That is, Cr is a component element that forms a stable oxidation layer ($Cr_2O_3$) when it is oxidized to thereby improve oxidation resistance. When the content of Cr is lower than 0.1 percent by mass, it is difficult to sufficiently develop the above effects, and carbide of Cr (chromium carbide) may excessively precipitate during casting to decrease the toughness of cast iron. On the other hand, when the content of Cr exceeds 1.0 percent by mass, the toughness of cast iron may decrease.

P is a component element for ensuring the toughness of cast iron. When the content of P exceeds 0.1 percent by mass, thermal degradation due to repeated heating and cooling easily occurs, and the toughness also tends to decrease. When the content of P is lower than 0.03 percent by mass, cast iron may cause intermediate temperature embrittlement at 400° C.

When a large amount of S is added, thermal degradation due to repeated heating and cooling easily occurs, and the toughness also decreases. When the content of S exceeds 0.03 percent by mass, the above phenomenon becomes remarkable.

Mg is a component element for spheroidizing graphite. When the content of Mg is lower than 0.02 percent by mass, spheroidization of graphite does not sufficiently take place.

On the other hand, when the content of Mg exceeds 0.15 percent by mass, the graphite spheroidizing effect is saturated, and the redundant Mg crystallizes out at a final solidification portion to possibly cause intermediate temperature embrittlement.

In addition, in the ferritic spheroidal graphite cast iron according to the present embodiment, the mass ratio of the content of Cr to the content of Mo (Cr/Mo) may range from 1.0 to 3.5. By adding Cr and Mo so that the mass ratio takes the above described range, carbide of Cr and carbide of Mo are formed at the same time. Thus, in comparison with addition of Cr alone, the amount of Cr solid soluble to the matrix ferrite phase increases. Therefore, diffusion of Cr to the surface layer due to oxidation is facilitated to easily form an oxidation layer ($Cr_2O_3$). Hence, the oxidation resistance improves as compared with addition of Cr or Mo alone. Then, when the mass ratio of the content of Cr to the content of Mo (Cr/Mo) is lower than 1.0 or exceeds 3.5, the oxidation resistance at high temperatures tends to decrease.

Furthermore, the ferritic spheroidal graphite cast iron may be subjected to ferritizing heat treatment by which a pearlite structure of a cast iron structure is transformed into a ferrite structure. In the thus treated ferritic spheroidal graphite cast iron, the pearlite structure of the cast iron structure is transformed into the ferrite structure. Thus, it is possible to improve the toughness of cast iron at room temperature, and it is possible to improve impact resistance. In addition, the hardness of cast iron may be decreased, so it is possible to improve machinability. The above heat treatment may include furnace cooling after being maintained at 750° C. to 950° C. for 2 to 3 hours and, in addition, standing to cool after being maintained at 500° C. to 750° C. for 3 to 6 hours.

Hereinafter, examples of the ferritic spheroidal graphite cast iron according to the present embodiment will be described. Two types of ferritic spheroidal graphite cast iron were manufactured to have components shown in Table 1 as Examples 1 and 2. Specifically, for each example, 50 kg raw material that includes components shown in Table 1 was prepared, and was subjected to atmospheric melting using a high-frequency induction heating furnace. Then, the material was poured out at a temperature of 1550° C. or above, and Fe—Si—Mg alloy was added in a ladle. In this way, graphite spheroidization was carried out. After that, the resultant material was inoculated using Fe—Si, and was then cast with a Y block at 1400° C. or above.

As in the case of Examples 1 and 2, two pieces of ferritic spheroidal graphite cast iron were manufactured as Comparative example 1 and 2. Comparative examples 1 and 2 differ from Examples 1 and 2 in that no Cr or Mo is included. The material of Comparative example 1 is high-silicon spheroidal graphite cast iron. In addition, austenitic spheroidal graphite cast iron equivalent to FCDA-NiSiCr3552 of Japanese Industrial Standards (JIS) was prepared as Comparative example 2.

TABLE 1

| Wt % | C | Si | Mn | P | S | Mg | Mo | Cr | Ni |
|---|---|---|---|---|---|---|---|---|---|
| Example 1 | 3.40 | 4.50 | 0.18 | 0.030 | 0.005 | 0.044 | 0.30 | 0.59 | — |
| Example 2 | 3.41 | 4.42 | 0.17 | 0.033 | 0.006 | 0.044 | 0.30 | 0.58 | — |
| Comparative Example 1 | 3.34 | 4.33 | 0.16 | 0.036 | 0.005 | 0.041 | 0.45 | — | — |
| Comparative Example 2 | 1.80 | 5.05 | 1.00 | 0.029 | 0.024 | 0.074 | — | 2.22 | 34.9 |

The materials of Example 1 and 2 and Comparative examples 1 and 2 were subjected to tensile test in conformity with the regulations of JISZ2241 at room temperature and at a temperature of 800° C. The results are shown in FIG. 1A and FIG. 1B.

Figure 2:
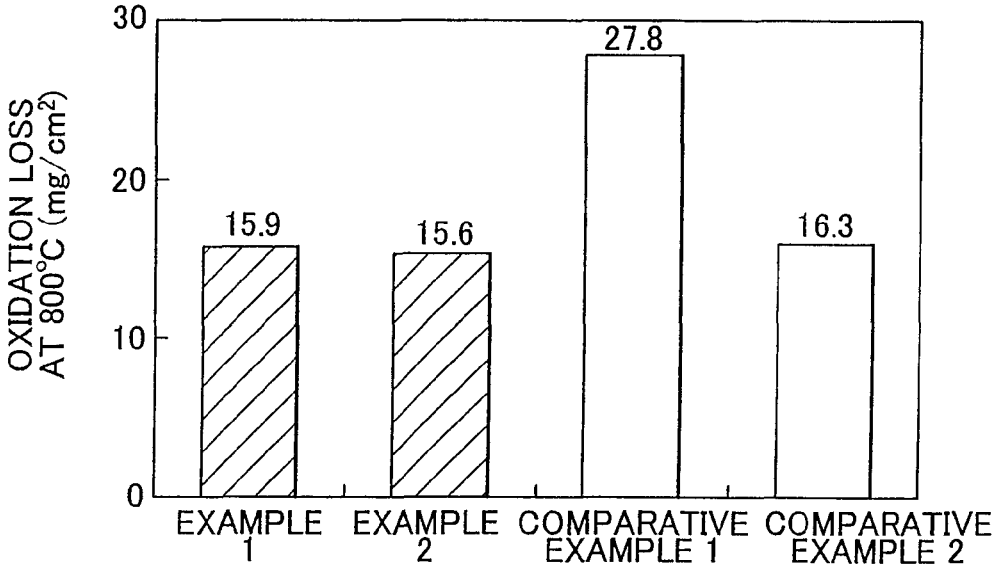
FIG. 2 is a graph that shows the oxidation losses of Examples 1 and 2 and Comparative examples 1 and 2 at 800° C.

The materials of Examples 1 and 2 and Comparative examples 1 and 2 were maintained at 800° C. for 100 hours in the atmosphere using a horizontal atmospheric furnace to oxidize cast iron, and, after that, losses of cast iron from which the oxidation layer was removed were measured. The results are shown in FIG. 2.

Figure 3:
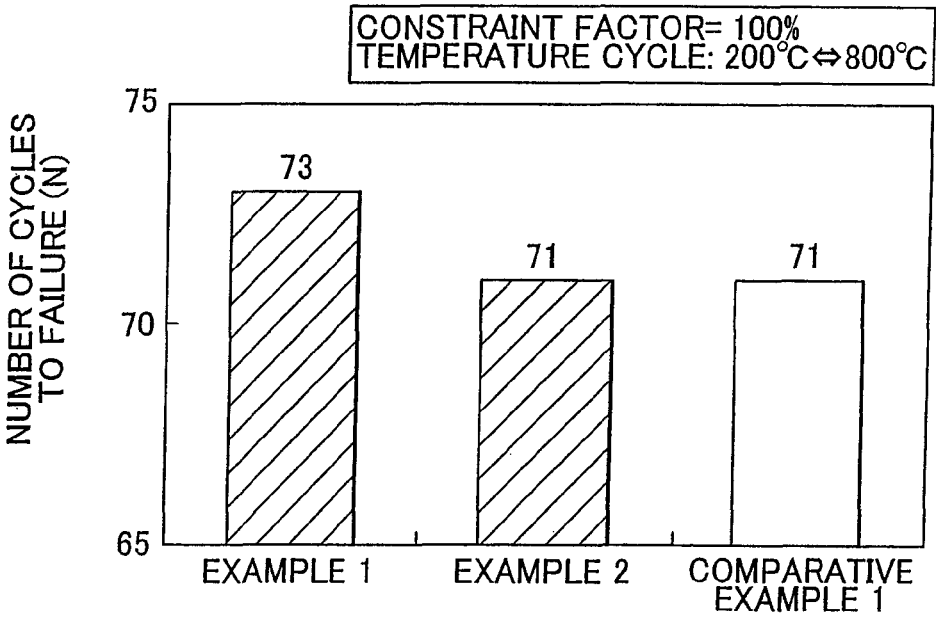
FIG. 3 is a graph that shows the results of the numbers of cycles to failure in thermal fatigue tests on Examples 1 and 2 and Comparative example 1.

The materials of Example 1 and 2 and Comparative example 1 were used to prepare test specimens having a gauge length of 15 mm and a gauge diameter of 8 mm. An electro-hydraulic servo thermal fatigue testing machine was used as a fatigue testing machine. In a state where thermal expansion elongation of each specimen due to heating was mechanically restrained completely, heating-cooling cycle (lower limit temperature: 200° C. and upper limit temperature: 800° C.) having a cycle period of 9 minutes was repeated until the specimen completely fails. Then, the thermal fatigue characteristic was evaluated on the basis of the number of cycles at which the specimen completely fails. The results are shown in FIG. 3.

Figure 1B:
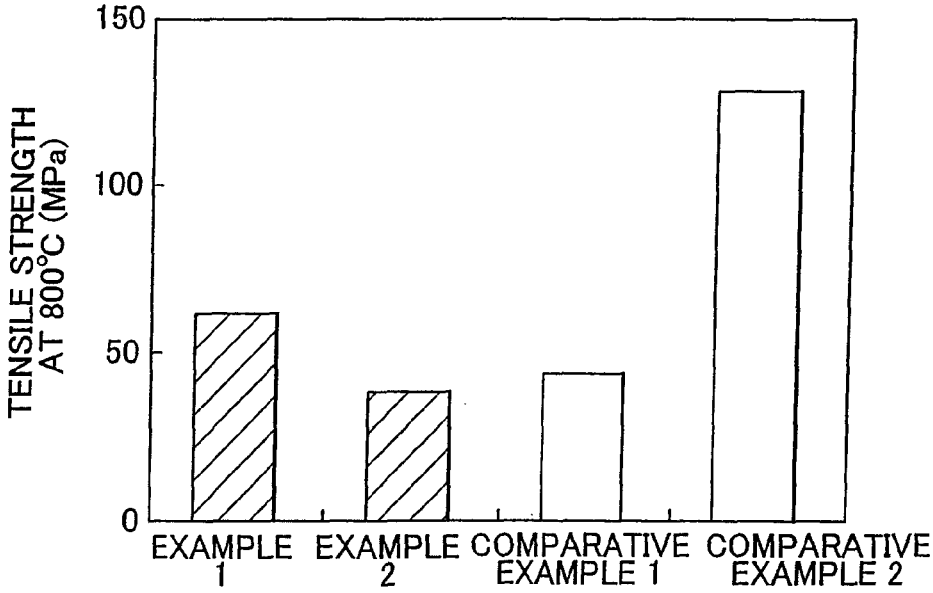

From FIG. 1A, FIG. 1B and Table 1, the tensile strengths at room temperature of Examples 1 and 2 are larger than those of Comparative examples 1 and 2. This is presumably because the content of Mo and the content of Cr are increased. From FIG. 2, the materials of Example 1 and 2 are improved in oxidation resistance as compared with that of Comparative example 1, and have oxidation resistance equivalent to that of the austenitic cast iron of Comparative example 2. This is presumably because Cr and Mo are included. In addition, from FIG. 3, the numbers of cycles to failure of Examples 1 and 2 are equivalent to or larger than that of Comparative example 1. This is also presumably because Cr and Mo are included to improve the high-temperature strength.

Figure 4:
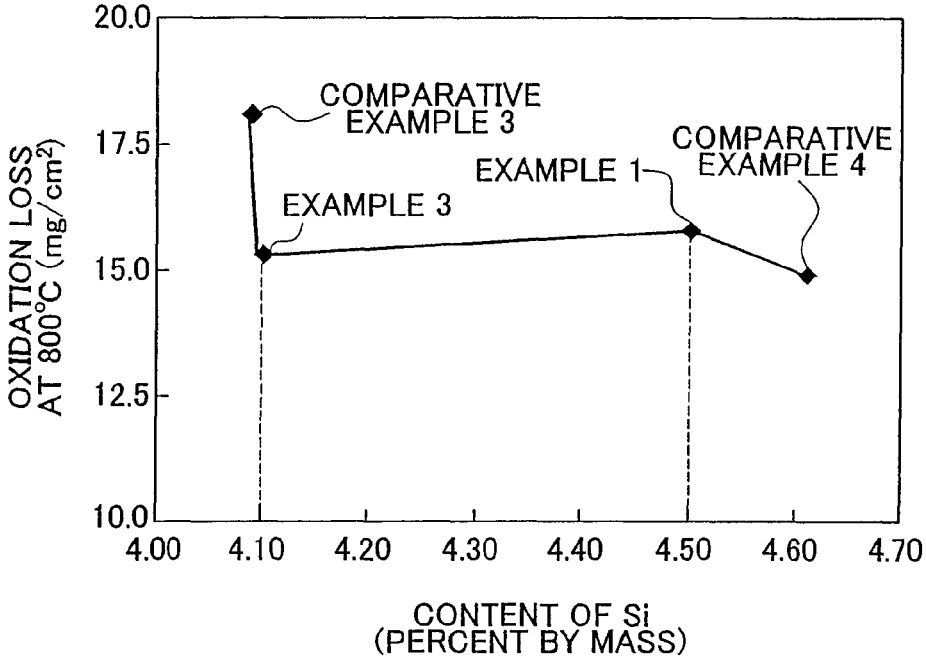
FIG. 4 is a graph that shows the oxidation losses of Examples 1 and 3 and Comparative examples 3 and 4 at 800° C. with respect to the content of Si.
Figure 5:
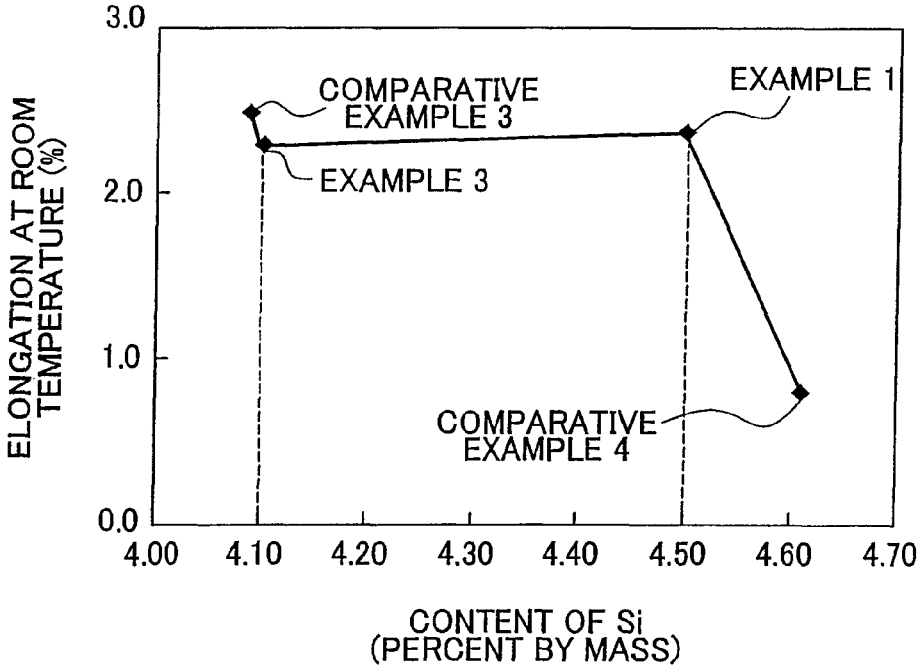
FIG. 5 is a graph that shows the results of elongations of Examples 1 and 3 and Comparative examples 3 and 4 at room temperature with respect to the content of Si.

As in the case of Example 1, ferritic spheroidal graphite cast iron having components shown in Table 2 was manufactured as Example 3. Example 3 differs from Example 1 in that the cast iron was formed so that the content of Si becomes the following component. Then, as in the case of Example 1, the cast iron of Example 3 was subjected to oxidation performance evaluation test and tensile test at room temperature. The results are shown in FIG. 4 and FIG. 5. Note that FIG. 4 is a graph that shows oxidation losses at 800° C. with respect to the content of Si, and FIG. 5 is a graph that shows elongations at room temperature with respect to the content of Si. Note that FIG. 4 and FIG. 5 also show the results for Example 1.

As in the case of Example 1, two pieces of ferritic spheroidal graphite cast iron having components shown in Table 2 were manufactured as Comparative examples 3 and 4. Comparative examples 3 and 4 differ from Example 1 in that the ferritic spheroidal graphite cast iron was manufactured so that, among the components described in the present embodiment, the content of Si falls outside the range of 4.1 to 4.5 percent by mass. Specifically, in Comparative example 3, the content of Si was lower than 4.1 percent by mass (4.09 percent by mass), and, in Comparative example 4, the content of Si exceeded 4.5 percent by mass (4.61 percent by mass). As in the case of Example 3, the pieces of cast iron of Comparative examples 3 and 4 were subjected to oxidation performance evaluation test and tensile test at room temperature. The results are shown in FIG. 4 and FIG. 5.

TABLE 2

| Wt % | C | Si | Mn | P | S | Mg | Mo | Cr |
|---|---|---|---|---|---|---|---|---|
| Comparative Example 3 | 3.32 | 4.09 | 0.15 | 0.029 | 0.003 | 0.041 | 0.29 | 0.60 |
| Example 3 | 3.31 | 4.10 | 0.21 | 0.043 | 0.002 | 0.043 | 0.31 | 0.61 |
| Comparative Example 4 | 3.29 | 4.61 | 0.25 | 0.035 | 0.005 | 0.042 | 0.31 | 0.59 |

As shown in FIG. 4 and FIG. 5, the oxidation losses of Examples 1 and 3 were smaller than that of Comparative example 3, and the elongations at room temperature of Examples 1 and 3 were larger than that of Comparative example 4. From the above results, it appears that the optimal content of Si ranges from 4.1 to 4.5 percent by mass. Then, it is presumable that, when the content of Si is lower than 4.1 percent by mass, it is difficult to sufficiently obtain oxidation resistance, so the oxidation loss increases, whereas, when the content of Si exceeds 4.5 percent by mass, the ferrite phase of the matrix becomes brittle, so the elongation considerably decreases.

Figure 6:
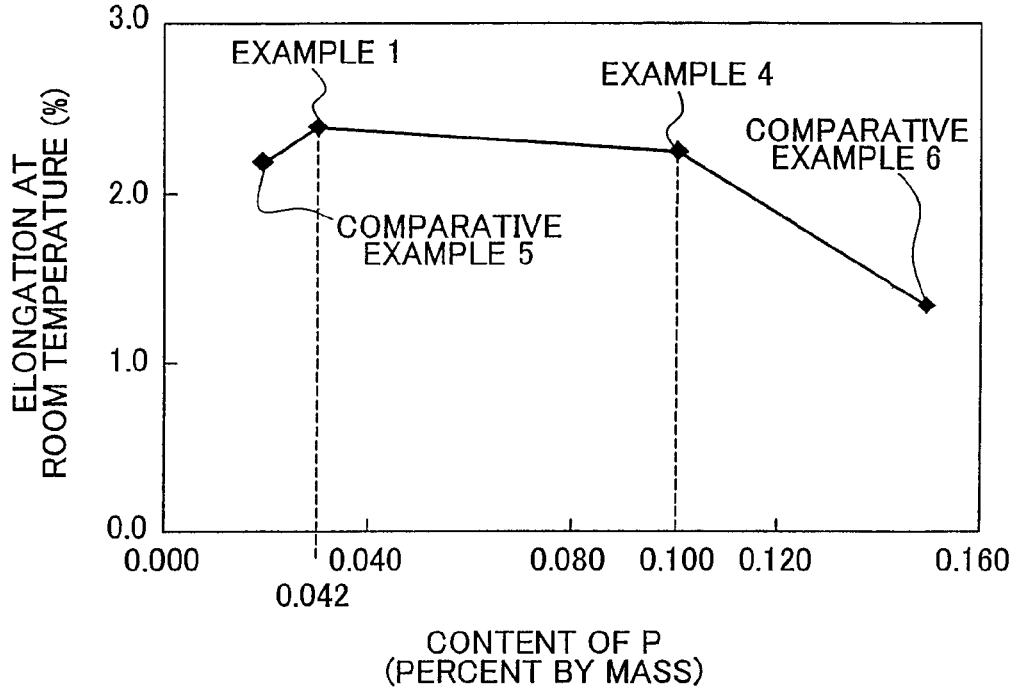
FIG. 6 is a graph that shows the results of elongations of Examples 1 and 4 and Comparative examples 5 and 6 at room temperature with respect to the content of P.
Figure 7:
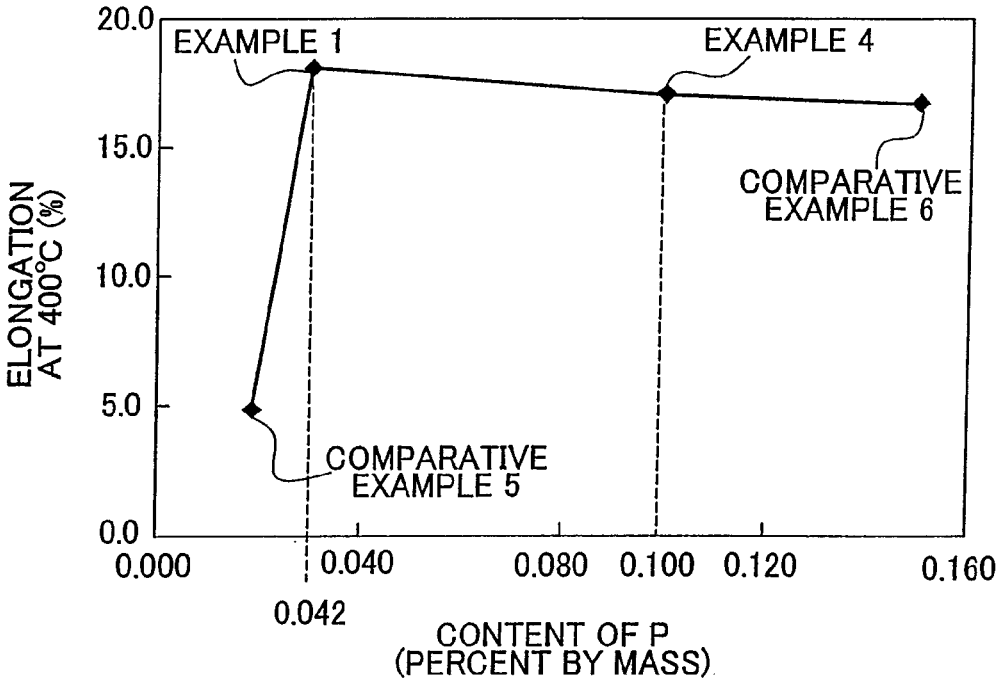
FIG. 7 is a graph that shows the results of elongations of Examples 1 and 4 and Comparative examples 5 and 6 at 400° C. with respect to the content of P.

As in the case of Example 1, ferritic spheroidal graphite cast iron having the components shown in Table 3 was manufactured as Example 4. Example 4 differs from Example 1 in that the cast iron was formed so that the content of P becomes the following component. Then, as in the case of Example 1, the cast iron of Example 4 was subjected to tensile test at room temperature and at 400° C. The results are shown in FIG. 6 and FIG. 7. Note that FIG. 6 is a graph that shows elongations at room temperature with respect to the content of P, and FIG. 7 is a graph that shows elongations at 400° C. with respect to the content of P. Note that FIG. 6 and FIG. 7 also show the results of tensile test for the cast iron of Example 1.

As in the case of Example 1, pieces of ferritic spheroidal graphite cast iron having the components shown in Table 3 were manufactured as Comparative examples 5 and 6. Comparative examples 5 and 6 differ from Example 1 in that the ferritic spheroidal graphite cast iron was manufactured so that, among the components and their ranges shown in the present embodiment, the content of P falls outside the range of 0.03 to 0.1 percent by mass. Specifically, in Comparative example 5, the content of P was lower than 0.03 percent by mass (0.019 percent by mass), and, in Comparative example 6, the content of P exceeded 0.1 percent by mass (0.15 percent by mass). As in the case of Example 4, the pieces of cast iron of Comparative examples 5 and 6 were subjected to tensile test at room temperature and at 400° C. The results are shown in FIG. 6 and FIG. 7.

TABLE 3

| Wt % | C | Si | Mn | P | S | Mg | Mo | Cr |
|---|---|---|---|---|---|---|---|---|
| Comparative Example 5 | 3.32 | 4.20 | 0.15 | 0.019 | 0.003 | 0.042 | 0.31 | 0.58 |
| Example 4 | 3.30 | 4.29 | 0.17 | 0.100 | 0.003 | 0.040 | 0.32 | 0.60 |
| Comparative Example 6 | 3.30 | 4.33 | 0.20 | 0.150 | 0.004 | 0.042 | 0.31 | 0.60 |

As shown in FIG. 6 and FIG. 7, any of the elongations at room temperature and the elongations at 400° C. of Examples 1 and 4 were larger than those of Comparative examples 5 and 6. From the above results, it appears that the optimal content of P ranges from 0.03 to 0.1 percent by mass. Then, it is presumable that, when the content of P is lower than 0.03 percent by mass, the cast iron becomes brittle at 400° C. to thereby decrease the elongation at 400° C., whereas, when the content of P exceeds 0.1 percent by mass, the amount of pearlite in the matrix increases, so the toughness decreases at room temperature to thereby decrease the elongation at room temperature.

Figure 8:
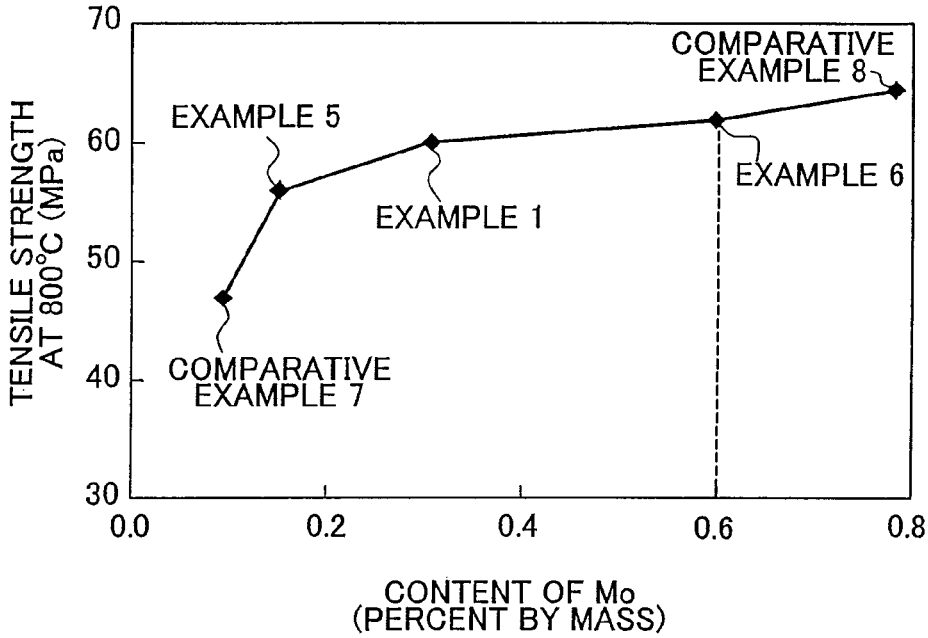
FIG. 8 is a graph that shows the results of tensile strengths of Examples 1, 5 and 6 and Comparative example 7 and 8 at 800° C. with respect to the content of Mo.
Figure 9:
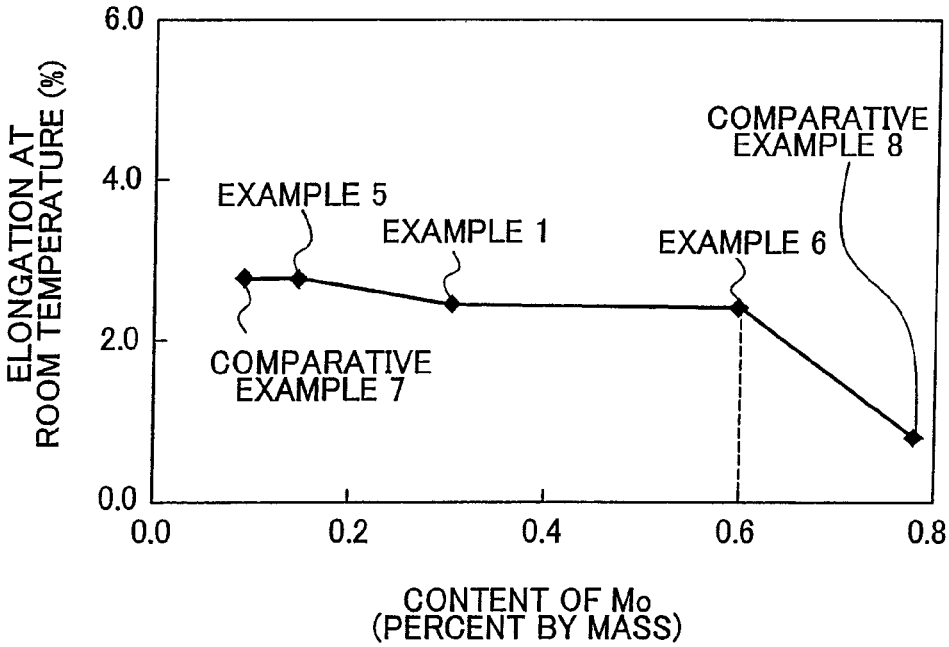
FIG. 9 is a graph that shows the results of elongations of Examples 1, 5 and 6 and Comparative examples 7 and 8 at room temperature with respect to the content of Mo.

As in the case of Example 1, pieces of ferritic spheroidal graphite cast iron having the components shown in Table 4 were manufactured as Examples 5 and 6. Examples 5 and 6 differ from Example 1 in that the cast iron was formed so that the content of Mo becomes the following component. Then, as in the case of Example 1, the two pieces of cast iron of Examples 5 and 6 were subjected to tensile test at room temperature and at 800° C. The results are shown in FIG. 8 and FIG. 9. Note that FIG. 8 is a graph that shows the tensile strengths at 800° C. with respect to the content of Mo, and FIG. 9 is a graph that shows the elongations at room temperature with respect to the content of Mo. Note that FIG. 8 and FIG. 9 also show the results of Example 1.

As in the case of Example 1, pieces of ferritic spheroidal graphite cast iron having the components shown in Table 4 were manufactured as Comparative examples 7 and 8. Comparative examples 7 and 8 differ from Example 1 in that the ferritic spheroidal graphite cast iron was manufactured so that, among the components shown in the present embodiment, the content of Mo falls outside the range of 0.1 to 0.6 percent by mass. Specifically, in Comparative example 7, the content of Mo was lower than 0.1 percent by mass (0.09 percent by mass), and, in Comparative example 8, the content of Mo exceeded 0.6 percent by mass (0.78 percent by mass). As in the case of Examples 5 and 6, the pieces of cast iron of Comparative examples 7 and 8 were subjected to tensile test at room temperature and at 800° C. The results are shown in FIG. 8 and FIG. 9.

TABLE 4

| Wt % | C | Si | Mn | P | S | Mg | Mo | Cr |
|---|---|---|---|---|---|---|---|---|
| Comparative Example 7 | 3.38 | 4.36 | 0.17 | 0.034 | 0.005 | 0.043 | 0.09 | 0.57 |
| Example 5 | 3.35 | 4.31 | 0.20 | 0.034 | 0.005 | 0.420 | 0.15 | 0.56 |
| Example 6 | 3.45 | 4.38 | 0.17 | 0.030 | 0.005 | 0.044 | 0.60 | 0.57 |
| Comparative Example 8 | 3.39 | 4.35 | 0.19 | 0.032 | 0.004 | 0.040 | 0.78 | 0.60 |

As shown in FIG. 8 and FIG. 9, the tensile strengths at 800° C. of Examples 1, 5 and 6 are larger than that of Comparative example 7, and the elongations at room temperature of Examples 1, 5 and 6 are larger than Comparative example 8. From the above results, it appears that the content of Mo optimally ranges from 0.1 to 0.6 percent by mass. Then, it is presumable that, when the content of Mo is lower than 0.1 percent by mass, the tensile strength at 800° C. decreases, whereas, when the content of Mo exceeds 0.6 percent by mass, the pearlite amount in the matrix increases, so the toughness decreases at room temperature to thereby decrease the elongation at room temperature. More desirably, the content of Mo is higher than 0.15 percent by mass.

Figure 10:
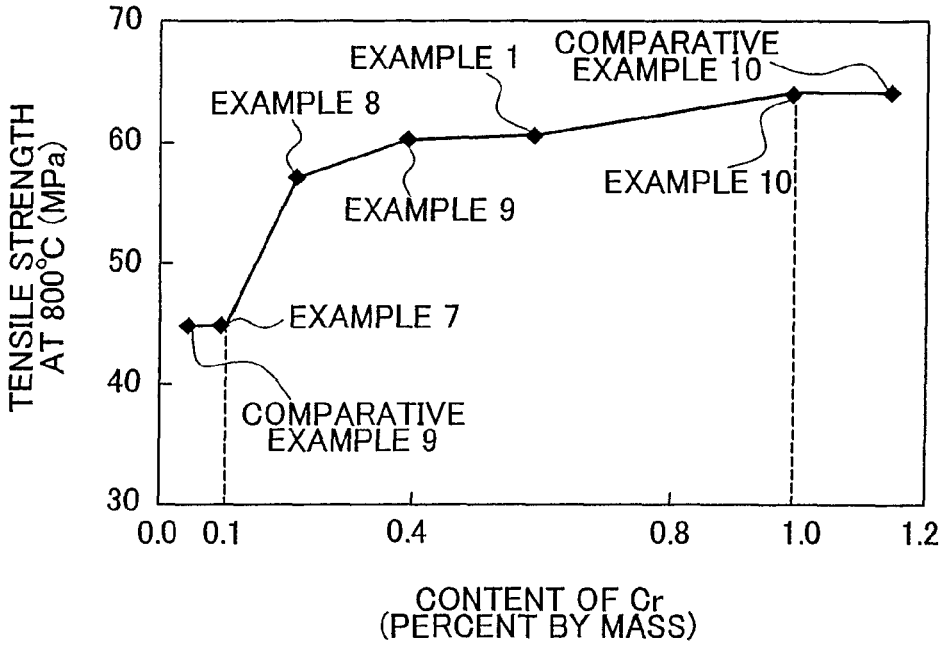
FIG. 10 is a graph that shows the results of tensile strengths of Examples 1 and 7 to 10 and Comparative examples 9 and 10 at 800° C. with respect to the content of Cr.
Figure 11:
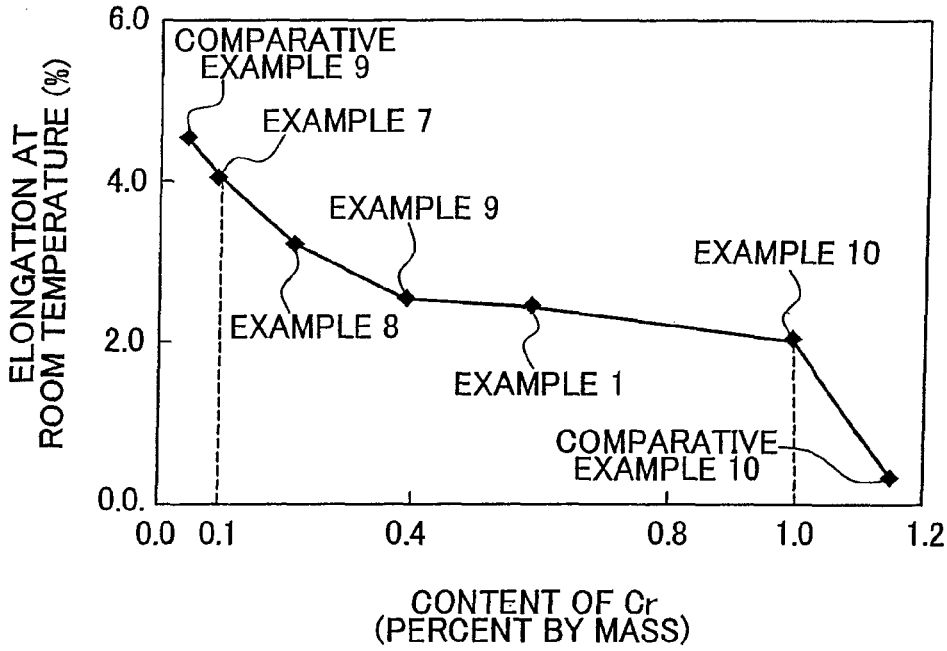
FIG. 11 is a graph that shows the results of elongations of Examples 1 and 7 to 10 and Comparative examples 9 and 10 at room temperature with respect to the content of Cr.
Figure 12:
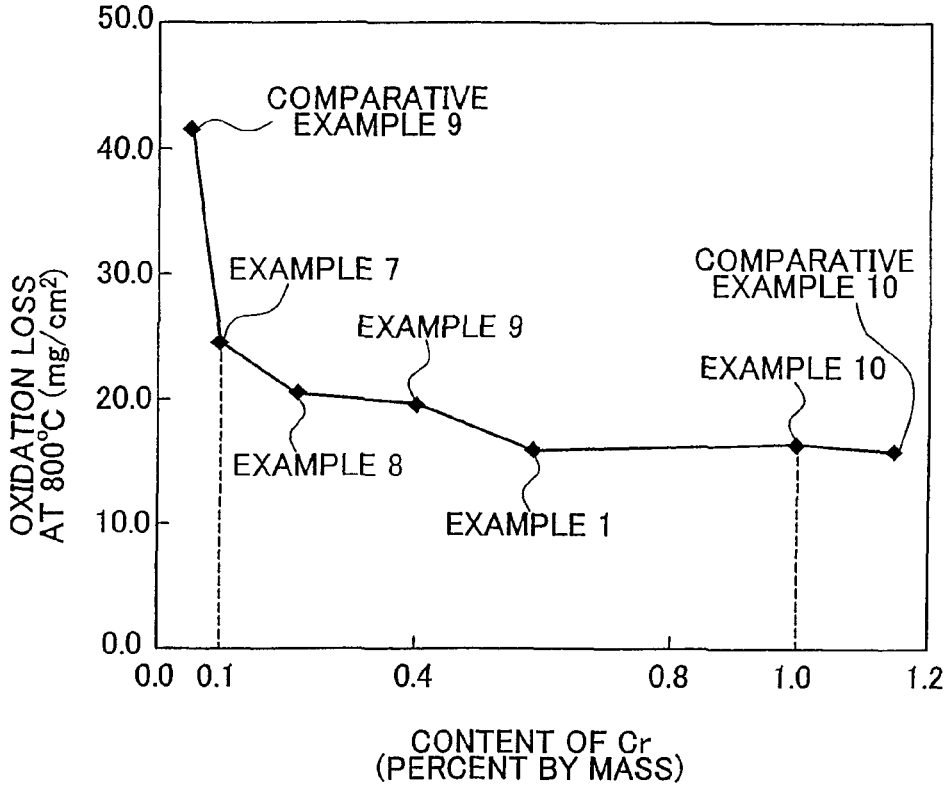
FIG. 12 is a graph that shows the results of oxidation losses of Examples 1 and 7 to 10 and Comparative examples 9 and 10 at 800° C. with respect to the content of Cr.

As in the case of Example 1, pieces of ferritic spheroidal graphite cast iron having the components shown in Table 5 were manufactured as Examples 7 to 10. Examples 7 to 10 differ from Example 1 in that the cast iron was formed so that the content of Cr becomes the following component. Then, as in the case of Example 1, the pieces of cast iron of Examples 7 to 10 were subjected to tensile test at room temperature and at 800° C. and oxidation performance evaluation test. The results are shown in FIG. 10 to FIG. 12. Note that FIG. 10 is a graph that shows the tensile strengths at 800° C. with respect to the content of Cr, FIG. 11 is a graph that shows the elongations at room temperature with respect to the content of Cr, and FIG. 12 is a graph that shows the oxidation losses at 800° C. with respect to the content of Cr. Note that FIG. 10 to FIG. 12 also show the results for Example 1.

As in the case of Example 1, pieces of ferritic spheroidal graphite cast iron having the components shown in Table 5 were manufactured as Comparative examples 9 and 10. Comparative examples 9 and 10 differ from Example 1 in that the ferritic spheroidal graphite cast iron was manufactured so that, among the components shown in the present embodiment, the content of Cr falls outside the range of 0.1 to 1.0 percent by mass. Specifically, in Comparative example 9, the content of Cr was lower than 0.1 percent by mass (0.05 percent by mass), and, in Comparative example 10, the content of Cr exceeded 1.0 percent by mass (1.15 percent by mass). As in the case of Examples 7 to 10, the pieces of cast iron of Comparative examples 9 and 10 were subjected to tensile test at room temperature and at 800° C. and oxidation performance evaluation test. The results are shown in FIG. 10 to FIG. 12.

TABLE 5

| Wt % | C | Si | Mn | P | S | Mg | Mo | Cr |
|---|---|---|---|---|---|---|---|---|
| Comparative Example 9 | 3.40 | 4.36 | 0.16 | 0.035 | 0.005 | 0.047 | 0.29 | 0.05 |
| Example 7 | 3.40 | 4.36 | 0.16 | 0.035 | 0.005 | 0.047 | 0.29 | 0.10 |
| Example 8 | 3.40 | 4.36 | 0.16 | 0.035 | 0.005 | 0.047 | 0.29 | 0.22 |
| Example 9 | 3.38 | 4.38 | 0.17 | 0.035 | 0.006 | 0.045 | 0.31 | 0.40 |
| Example 10 | 3.35 | 4.39 | 0.20 | 0.033 | 0.003 | 0.042 | 0.29 | 1.00 |
| Comparative Example 10 | 3.42 | 4.40 | 0.19 | 0.031 | 0.004 | 0.04 | 0.33 | 1.15 |

As shown in FIG. 10 to FIG. 12, the tensile strengths at 800° C. of Examples 1 and 8 to 10 are larger than that of Comparative example 9, and the tensile strengths at 800° C. improved with an increase in the content of Cr. The elongations at room temperature of Examples 1 and 7 to 10 are larger than that of Comparative example 10. In addition, the oxidation losses of Examples 1 and 7 to 10 are smaller than that of Comparative example 9. From the above results, it appears that the content of Cr optimally ranges from 0.1 to 1.0 percent by mass. Then, it is presumable that, when the content of Cr is smaller than 0.1 percent by mass, the oxidation resistance and the high-temperature strength decreases to thereby increase the oxidation loss at 800° C. On the other hand, it is presumable that, when the content of Cr exceeds 1.0 percent by mass, carbide of Cr (chromium carbide) excessively precipitates during casting, so the toughness of cast iron decreases to thereby decrease the elongation at room temperature.

Figure 13:
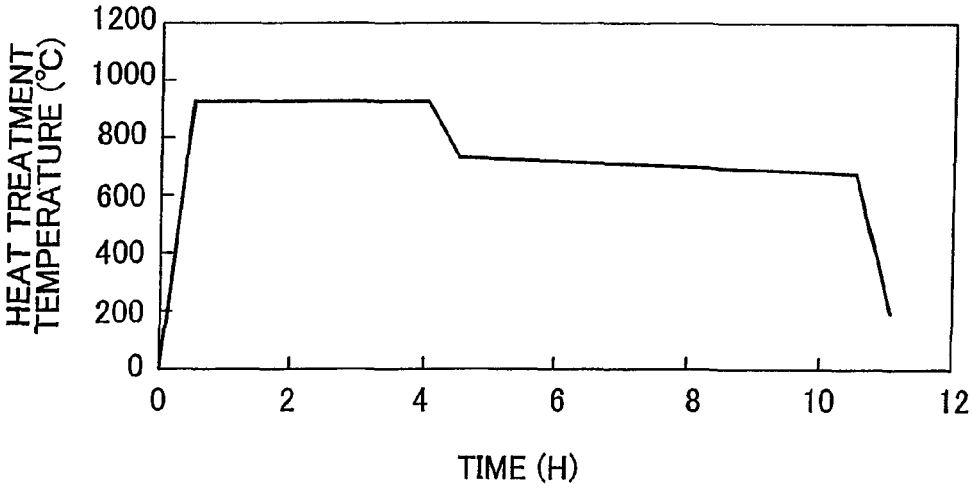
FIG. 13 is a graph that shows the temperature profile of Example 11 in heat treatment (ferritizing heat treatment)
Figure 14:
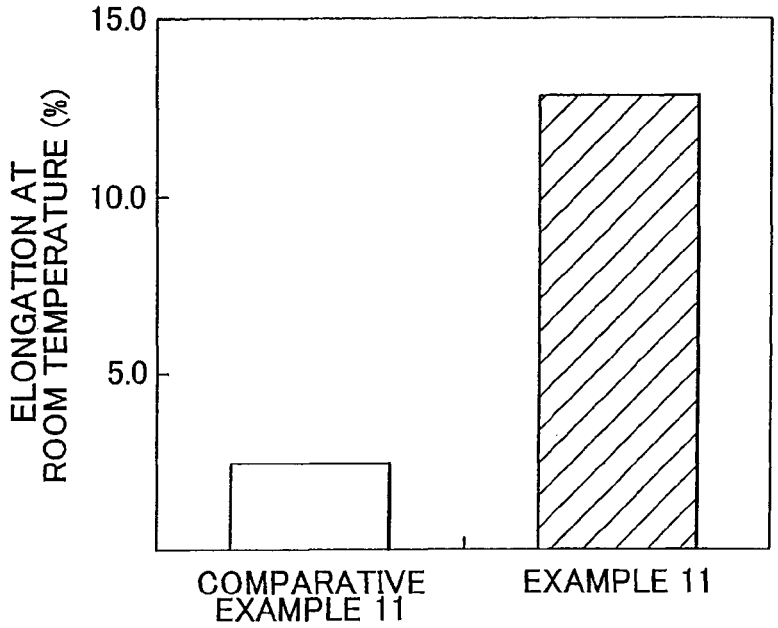
FIG. 14 is a graph that shows the results of elongations of Example 11 and Comparative example 11 at room temperature.
Figure 15:
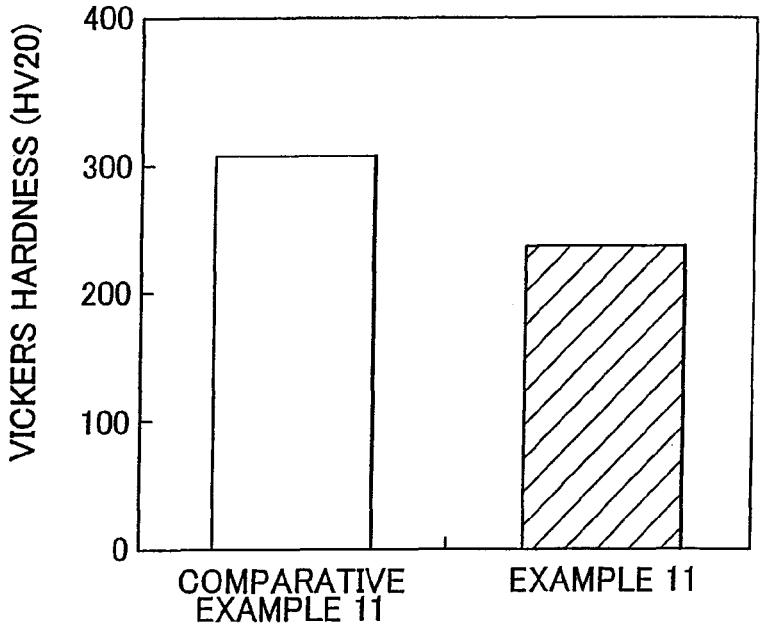
FIG. 15 is a graph that shows the Vickers hardness of Example 11 and the Vickers hardness of Comparative example 11.
Figure 16:
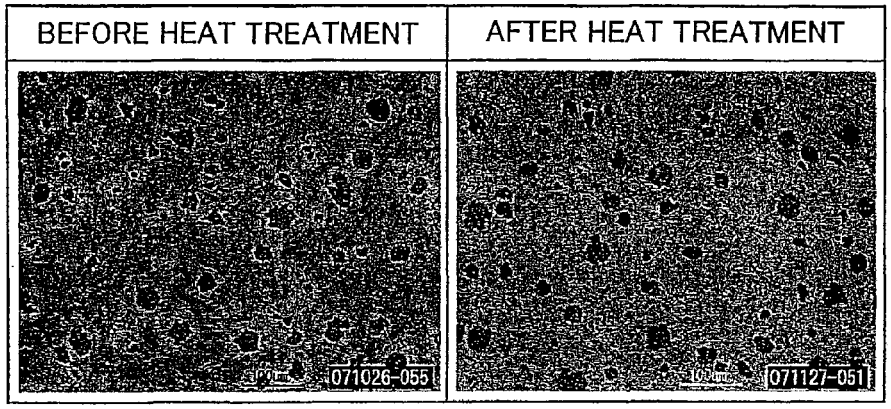
FIG. 16 shows the photographs of the structures of Example 11 before and after heat treatment.

As in the case of Example 2, ferritic spheroidal graphite cast iron was manufactured as Example 11, and was subjected to heat treatment (ferritizing heat treatment) with the temperature profile shown in FIG. 13. Specifically, the conditions of heat treatment include furnace cooling after being maintained at 930° C. for 3.5 hours and, in addition, standing to cool after being maintained at 680° C. to 730° C. for 6 hours. Then, Example 11 was subjected to tensile test as in the case of Example 1. In addition, a Vickers hardness tester was used to measure the surface hardness at an indentation load of 196.1 N. The results are shown in FIG. 14 and FIG. 15. In addition, the photographs of the structures before and after heat treatment were observed. The results are shown in FIG. 16.

As in the case of Example 2, ferritic spheroidal graphite cast iron was manufactured as Comparative example 11. Comparative example 11 differs from Example 11 in that the ferritic spheroidal graphite cast iron of Comparative example 11 was not subjected to the above described heat treatment. Then, as in the case of Example 11, Comparative example 11 was subjected to tensile test at room temperature and hardness test. The results are shown in FIG. 14 and FIG. 15.

As shown in FIG. 14, the elongation at room temperature of Example 11 is larger than that of Comparative example 11. In addition, as shown in FIG. 15, the hardness of Example 11 is lower than that of Comparative example 11. In addition, as shown in FIG. 16, in Example 11, because of heat treatment, the pearlite structure of the cast iron structure was transformed into a ferrite structure.

From the above results, it is presumable that the pearlite structure of the cast iron structure is transformed into a ferrite structure to decompose carbide having a high hardness in the matrix, so the hardness decreases as compared with the hardness before heat treatment.

Figure 17:
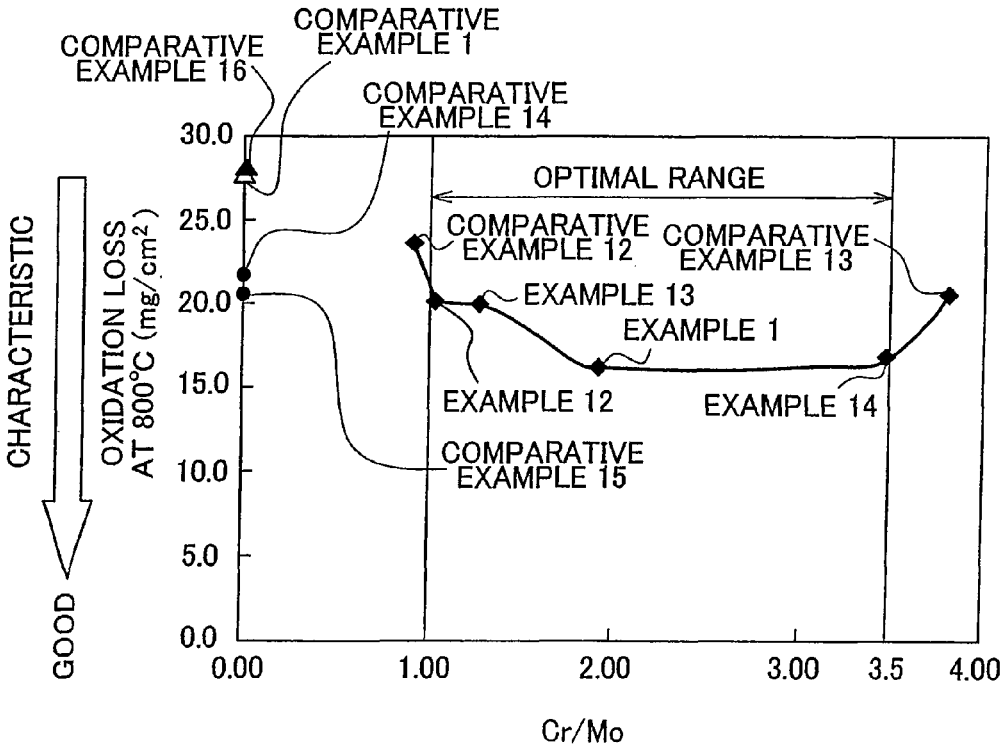
FIG. 17 is a graph that shows the results of oxidation losses of Examples 1 and 12 to 14 and Comparative examples 1 and 12 to 16 at 800° C. with respect to the mass ratio of Cr to Mo (Cr/Mo).

As in the case of Example 1, pieces of ferritic spheroidal graphite cast iron having the components shown in Table 6 were manufactured as Examples 12 to 14. Examples 12 to 14 differ from Example 1 in that the pieces of cast iron were formed so that Cr/Mo (mass ratio of the content of Cr to the content of Mo (Cr/Mo)) becomes the following mass ratios. Then, as in the case of Example 1, the pieces of cast iron of Examples 12 to 14 were subjected to oxidation performance evaluation test. The results are shown in FIG. 17. Note that FIG. 17 also shows the results for Example 1. Note that, in the cast iron of Example 1, the mass ratio of the content of Cr to the content of Mo (Cr/Mo) is 1.97.

As in the case of Example 1, pieces of ferritic spheroidal graphite cast iron having the components shown in Table 6 were manufactured as Comparative examples 12 to 16. Comparative examples 12 to 16 differ from Example 1 in that the cast iron was formed so that the mass ratio of the content of Cr to the content of Mo (Cr/Mo) falls outside the range of 1.0 to 3.5. Then, as in the case of Examples 12 to 14, the pieces of cast iron of Comparative examples 12 to 16 were subjected to oxidation performance evaluation test. The results are shown in FIG. 17. Note that FIG. 17 also shows the results of Comparative example 1. Table 6 and FIG. 17 show Comparative examples 12 and 13 for comparison with Examples 12 to 14; however, Comparative examples 12 and 13 correspond to examples included in the aspect of the invention.

TABLE 6

| Wt % | C | Si | Mn | P | S | Mg | Mo | Cr | Cr/Mo |
|---|---|---|---|---|---|---|---|---|---|
| Comparative Example 12 | 3.41 | 4.35 | 0.18 | 0.029 | 0.004 | 0.039 | 0.27 | 0.25 | 0.93 |
| Example 12 | 3.40 | 4.40 | 0.19 | 0.031 | 0.004 | 0.040 | 0.49 | 0.51 | 1.04 |

TABLE 6-continued

| Wt % | C | Si | Mn | P | S | Mg | Mo | Cr | Cr/Mo |
|---|---|---|---|---|---|---|---|---|---|
| Example 13 | 3.38 | 4.38 | 0.17 | 0.035 | 0.006 | 0.045 | 0.31 | 0.40 | 1.29 |
| Example 14 | 3.35 | 4.39 | 0.20 | 0.033 | 0.003 | 0.042 | 0.29 | 1.00 | 3.45 |
| Comparative Example 13 | 3.42 | 4.36 | 0.19 | 0.030 | 0.004 | 0.038 | 0.11 | 0.42 | 3.82 |
| Comparative Example 14 | 3.41 | 4.30 | 0.18 | 0.032 | 0.004 | 0.0045 | — | 0.50 | |
| Comparative Example 15 | 3.39 | 4.32 | 0.18 | 0.031 | 0.006 | 0.0043 | — | 1.00 | |
| Comparative Example 16 | 3.38 | 4.35 | 0.17 | 0.033 | 0.004 | 0.0045 | 0.98 | 0.00 | |

As shown in FIG. 17, the oxidation losses of Example 1 and 12 to 14 are smaller than those of Comparative examples 1 and 13 to 16. In addition, the oxidation losses of Examples 1 and 14 are particularly small.

From the above results, it is assumed that the mass ratio of the content of Cr to the content of Mo (Cr/Mo) desirably falls within the range of 1.0 to 3.5, and the mass ratio (Cr/Mo) more desirably falls within the range of 1.97 to 3.45. Carbide of Cr and carbide of Mo are formed at the same time by adding Cr and Mo, so, in comparison with addition of Cr alone, the amount of Cr solid soluble to the matrix ferrite phase increases. Therefore, it is presumable that diffusion of Cr to the surface layer due to oxidation is facilitated to easily form an oxidation layer ($Cr_2O_3$) and, hence, the oxidation resistance improves as compared with addition of Cr or Mo alone. As a result, it is presumable that, when the mass ratio of the content of Cr to the content of Mo (Cr/Mo) is lower than 1.0, oxidation resistance at high temperatures decreases.

While some embodiments of the invention have been illustrated above, it is to be understood that the invention is not limited to details of the illustrated embodiments, but may be embodied with various changes, modifications or improvements, which may occur to those skilled in the art, without departing from the scope of the invention.

The invention claimed is:

1. A ferritic spheroidal graphite cast iron comprising:
3.1 to 3.5 percent by mass of carbon;
4.1 to 4.5 percent by mass of silicon;
0.8 percent by mass or below of manganese;
0.1 to 0.6 percent by mass of molybdenum;
0.1 to 1.0 percent by mass of chromium;
0.03 to 0.1 percent by mass of phosphorus;
0.03 percent by mass or below of sulfur;
0.02 to 0.15 percent by mass of magnesium; and
Iron,
wherein the mass ratio of the content of chromium to the content of molybdenum ranges from 58/30 to 3.5.

2. The ferritic spheroidal graphite cast iron according to claim 1, wherein ferritizing heat treatment is applied to transform a pearlite structure of a cast iron structure into a ferrite structure.

3. The ferritic spheroidal graphite cast iron according to claim 1, further comprising unavoidable impurities.

4. The ferritic spheroidal graphite cast iron according to claim 1, wherein the sum of the product of the content of silicon multiplied by ⅓ and the content of carbon ranges from 4.5 to 5.0 percent by mass.

5. The ferritic spheroidal graphite cast iron according to claim 1, wherein
the content of manganese is higher than or equal to 0.16 percent by mass, and
the content of sulfur is higher than or equal to 0.002 percent by mass.

6. The ferritic spheroidal graphite cast iron according to claim 1, wherein the content of molybdenum is higher than or equal to 0.15 percent by mass.

7. A manufacturing method for ferritic spheroidal graphite cast iron, comprising:
preparing raw material that includes carbon, silicon, manganese, molybdenum, chromium, phosphorus, sulfur, magnesium and iron;
melting the raw material;
applying graphite spheroidization by adding Fe—Si—Mg alloy to the melted raw material;
inoculating the raw material, which has been subjected to the graphite spheroidization, using Fe—Si; and
casting the inoculated raw material at 1400° C. or above, wherein
the inoculated raw material includes 3.1 to 3.5 percent by mass of carbon, 4.1 to 4.5 percent by mass of silicon, 0.16 to 0.8 percent by mass of manganese, 0.1 to 0.6percent by mass of molybdenum, 0.1 to 1.0 percent by mass of chromium, 0.03 to 0.1percent by mass of phosphorus, 0.002 to 0.03 percent by mass of sulfur, and 0.02 to 0.15 percent by mass of magnesium, and
wherein the mass ratio of the content of chromium to the content of molybdenum in the inoculated raw material ranges from 58/30 to 3.5.

8. The manufacturing method according to claim 7, further comprising:
maintaining the cast raw material at 750° C. to 950° C. for 2 to 3 hours;
maintaining the raw material, which has been maintained at 750° C. to 950° C., at 500° C. to 750° C. for 3 to 6 hours; and
cooling the raw material that has been maintained at 500° C. to 750° C.

9. The manufacturing method according to claim 7, wherein the sum of the product of the content of silicon in the inoculated raw material multiplied by ⅓ and the content of carbon in the inoculated raw material ranges from 4.5 to 5.0 percent by mass.

10. The manufacturing method according to claim 7, wherein the content of molybdenum in the inoculated raw material is higher than or equal to 0.15 percent by mass.

11. The ferritic spheroidal graphite cast iron according to claim 1, wherein the mass ratio of the content of chromium to the content of molybdenum ranges from 1.97 to 3.45.

12. The manufacturing method according to claim 7, wherein the mass ratio of the content of chromium to the content of molybdenum in the inoculated raw material ranges from 1.97 to 3.45.

* * * * *